US012258838B2

(12) United States Patent
Xiao et al.

(10) Patent No.: US 12,258,838 B2
(45) Date of Patent: Mar. 25, 2025

(54) FLOW REGULATING VALVE

(71) Applicant: SAUDI ARABIAN OIL COMPANY, Dhahran (SA)

(72) Inventors: Jinjiang Xiao, Dhahran (SA); Songlin Zhong, Dhahran (SA); Chidirim Enoch Ejim, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 76 days.

(21) Appl. No.: 18/046,721

(22) Filed: Oct. 14, 2022

(65) Prior Publication Data

US 2024/0125207 A1 Apr. 18, 2024

(51) Int. Cl.

| | |
|---|---|
| ***E21B 43/12*** | (2006.01) |
| ***E21B 34/06*** | (2006.01) |
| ***E21B 34/14*** | (2006.01) |
| ***F04B 47/06*** | (2006.01) |
| ***F04B 49/03*** | (2006.01) |

(52) U.S. Cl.

CPC ..... *E21B 34/14* (2013.01); *E21B 34/066* (2013.01); *E21B 43/128* (2013.01); *F04B 47/06* (2013.01); *F04B 49/03* (2013.01); *E21B 2200/05* (2020.05)

(58) Field of Classification Search

CPC ..... E21B 2200/06; E21B 43/128; F04D 15/0022; F04B 49/03

See application file for complete search history.

(56) References Cited

U.S. PATENT DOCUMENTS 4,625,798 A * 12/1986 Bayh, III ..... E21B 43/128 166/319
5,070,944 A 12/1991 Hopper
6,253,843 B1 7/2001 Rawson et al.
(Continued)

FOREIGN PATENT DOCUMENTS

| | | | |
|---|---|---|---|
| EP | 2554786 | A1 | 2/2013 |
| WO | 2016050301 | A1 | 4/2016 |
| WO | 2016182451 | A1 | 11/2016 |

OTHER PUBLICATIONS

"Specification for Subsurface Safety Valve Equipment", American Petroleum Institute; API Specification 14A; Twelfth Edition; Jan. 2015 (150 pages).

*Primary Examiner* — Tara Schimpf
*Assistant Examiner* — Ursula Lee Norris
(74) *Attorney, Agent, or Firm* — Osha Bergman Watanabe & Burton LLP

(57) ABSTRACT

A system includes an electric submersible pump and a flow regulating valve. The electrical submersible pump includes a pump that, when activated, receives a fluid disposed within a production tubing of a well through a pump intake and vents the fluid through a pump discharge to a surface location. The flow regulating valve includes a flow tube that blocks the fluid from entering the pump intake when the pump is inactive, a piston, connected to the flow tube, that moves the flow tube within the flow regulating valve, and a stinger that includes a conduit for the fluid to flow from the production tubing to the pump. The flow regulating valve further includes a spring that positions the piston within the flow regulating valve when the pump is inactive and a plurality of seals that pressure-seal a pressure chamber which houses a pressure force that is to be applied upon the piston.

20 Claims, 8 Drawing Sheets

(56) References Cited

U.S. PATENT DOCUMENTS

| | | | | |
|---|---|---|---|---|
| 8,038,120 | B2 | 10/2011 | Vick et al. | |
| 8,453,748 | B2 | 6/2013 | Vick et al. | |
| 8,464,799 | B2 | 6/2013 | Scott et al. | |
| 8,919,730 | B2 | 12/2014 | Vick | |
| 10,174,589 | B2 | 1/2019 | Vick et al. | |
| 10,670,160 | B2 | 6/2020 | Phelps | |
| 10,927,643 | B2 | 2/2021 | Ejim et al. | |
| 11,965,396 | B1 * | 4/2024 | Xiao | E21B 43/128 |
| 2004/0173362 | A1 | 9/2004 | Waithman et al. | |
| 2012/0199367 | A1 | 8/2012 | Bouldin et al. | |
| 2013/0175025 | A1 * | 7/2013 | Vick, Jr. | E21B 34/16 166/321 |
| 2013/0175042 | A1 | 7/2013 | Scott et al. | |
| 2014/0000870 | A1 | 1/2014 | Vick et al. | |
| 2020/0256159 | A1 | 8/2020 | Vick et al. | |
| 2021/0230974 | A1 * | 7/2021 | Frost | E21B 43/35 |
| 2021/0246771 | A1 | 8/2021 | Ejim et al. | |

* cited by examiner

FLOW REGULATING VALVE

BACKGROUND

In the oil and gas industry, hydrocarbons are located in reservoirs far beneath the Earth's surface. Wells are drilled into these reservoirs to produce said hydrocarbons. The structure of a well is made of a plurality of casing strings cemented in place. A production string is set within the innermost casing string. The production string is used to provide a conduit for production fluids, such as hydrocarbons, to flow from the reservoir to the surface of the Earth. The production string is made of production tubing and downhole production equipment. A subsurface safety valve (SSSV) is frequently installed as part of the production tubing to aid in well control.

A SSSV is a valve that is designed to shut off flow, through the production tubing, in a well control scenario. A SSSV may be deep-set or shallow-set. A deep-set SSSV is set downhole from the downhole production equipment. Thus, when a tool needs to be run into the production tubing to workover the downhole production equipment, a conduit, such as wireline, does not need to pass through the deep-set SSSV. However, a deep-set SSSV leaves a significant volume of hydrocarbons between the deep-set SSSV and the surface which creates more operational risk. A shallow-set SSSV is set much closer to the surface, above the downhole production equipment. However, the shallow-set SSSV must be designed in a way to shut off flow when a conduit is run through the production tubing.

SUMMARY

In one aspect, embodiments of the present invention relate to a system comprising an electric submersible pump and a flow regulating valve. The electrical submersible pump includes a pump that, when activated, receives a fluid disposed within a production tubing of a well through a pump intake and vents the fluid through a pump discharge to a surface location. The flow regulating valve includes a flow tube that blocks the fluid from entering the pump intake when the pump is inactive, a piston, connected to the flow tube, that moves the flow tube within the flow regulating valve, and a stinger that includes a conduit for the fluid to flow from the production tubing to the pump. The flow regulating valve further includes a spring that positions the piston within the flow regulating valve when the pump is inactive and a plurality of seals that pressure-seal a pressure chamber which houses a pressure force that is to be applied upon the piston.

In one aspect, embodiments of the present invention relate to a method comprising activating a pump of an electric submersible pump, pressure-sealing a pressure chamber of a flow regulating valve with a plurality of seals such that a force within the pressure chamber is applied upon a piston, moving a flow tube within the flow regulating valve by the piston, and receiving a fluid through a pump intake from a production tubing of a well. That is, the fluid flows from the production tubing to the pump intake through a stinger that includes a conduit. The method further includes venting the fluid to a surface location by a pump discharge, positioning the piston within the flow regulating valve when the pump is inactive by a spring, and blocking the fluid from entering the pump intake by the flow tube.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

This disclosure describes systems and methods operating a Subsurface Safety Valve (SSSV). The systems and methods include an ESP having a pump, a pump intake, and a pump discharge. The systems and methods also include a flow regulating valve having a flow tube, a piston, a stinger, a spring, and a plurality of seals. The techniques discussed in this disclosure are beneficial in reducing sand accumulation within ESP systems and simplify operational deployment and retrieval challenges associated with Cable Deployed Electric Submersible Pump (CDESP) systems.

Figure 1:
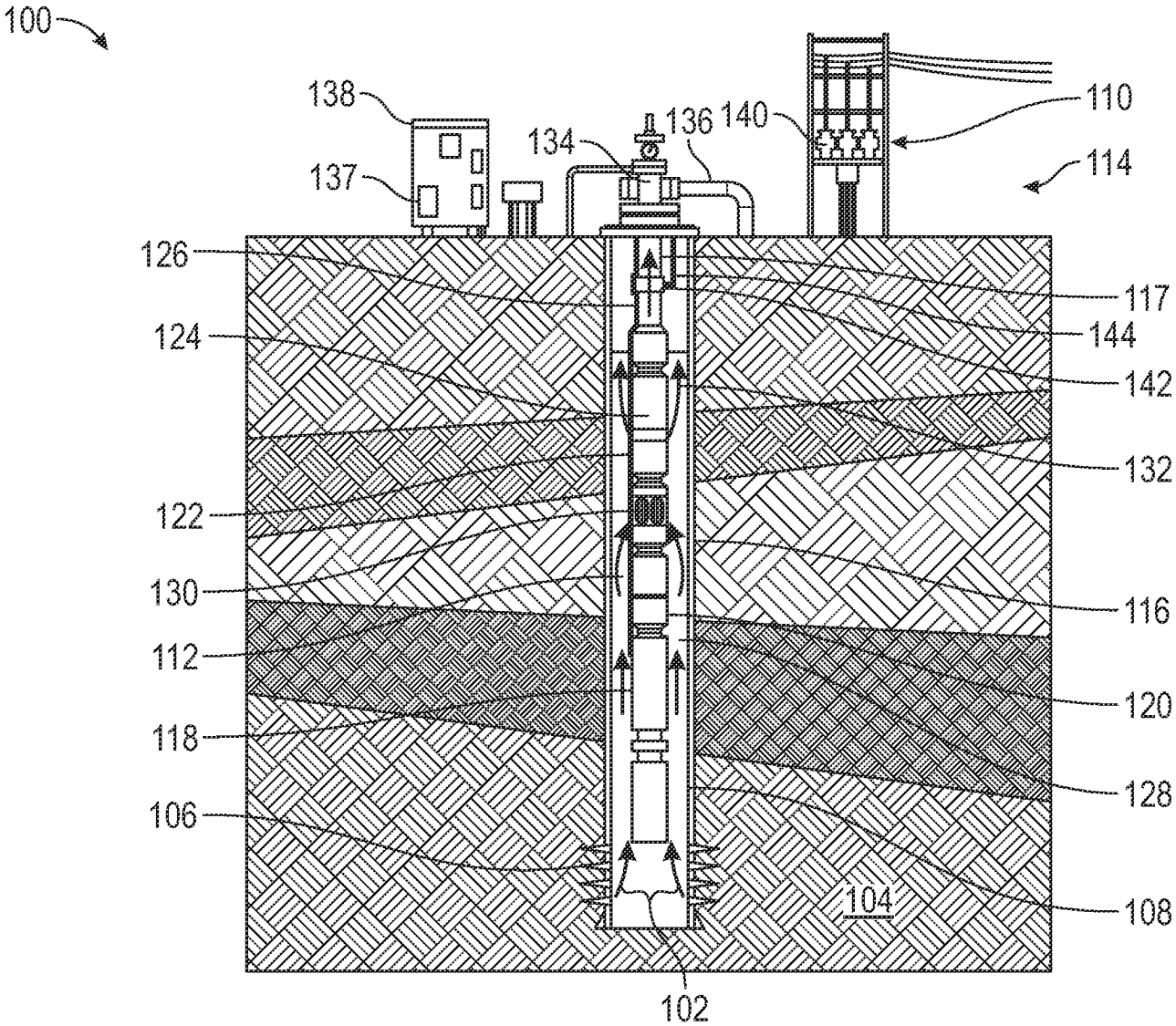
FIG. 1 shows an exemplary well with an Electrical Submersible Pump (ESP) completion design in accordance with one or more embodiments.

FIG. 1 shows an exemplary ESP system (100). The ESP system (100) is used to help produce fluids (102) from a formation (104). Perforations (106) in the casing string (108) of the well (116) provide a conduit for the fluid (102) to enter the well (116) from the formation (104). The ESP system (100) includes surface equipment (110) and an ESP string (112). The ESP string (112) is deployed in a well (116) on production tubing (117) and the surface equipment (110) is located on a surface location (114). The surface location (114) is any location outside of the well (116), such as the Earth's surface. The production tubing (117) extends to the surface location (114) and is made of a plurality of tubulars connected together to provide a conduit for formation fluids (102) to migrate to the surface location (114).

The ESP string (112) may include a motor (118), motor protectors (120), a gas separator (122), a multi-stage centrifugal pump (124) (herein called a "pump" (124)), and an electrical cable (126). The ESP string (112) may also include various pipe segments of different lengths to connect the components of the ESP string (112). The motor (118) is a downhole submersible motor (118) that provides power to the pump (124). The motor (118) may be a two-pole, three-phase, squirrel-cage induction electric motor (118). The motor's (118) operating voltages, currents, and horsepower ratings may change depending on the requirements of the operation.

The size of the motor (118) is dictated by the amount of power that the pump (124) requires to lift an estimated volume of fluid (102) from the bottom of the well (116) to the surface location (114). The motor (118) is cooled by the fluid (102) passing over the motor (118) housing. The motor (118) is powered by the electrical cable (126). The electrical cable (126) may also provide power to downhole pressure sensors or onboard electronics that may be used for communication. The electrical cable (126) is an electrically conductive cable that is capable of transferring information. The electrical cable (126) transfers energy from the surface equipment (110) to the motor (118). The electrical cable (126) may be a three-phase electric cable that is specially designed for downhole environments. The electrical cable (126) may be clamped to the ESP string (112) in order to limit electrical cable (126) movement in the well (116). In further embodiments, the ESP string (112) may have a hydraulic line that is a conduit for hydraulic fluid. The hydraulic line may act as a sensor to measure downhole parameters such as discharge pressure from the outlet of the pump (124).

Motor protectors (120) may be located above (i.e., closer to the surface location (114)) the motor (118) in the ESP string (112). The motor protectors (120) are a seal section that houses a thrust bearing. The thrust bearing accommodates axial thrust from the pump (124) such that the motor (118) is protected from axial thrust. The seals isolate the motor (118) from the fluid (102). The seals further equalize the pressure in the annulus (128) with the pressure in the motor (118). The annulus (128) is the space in the well (116) between the casing string (108) and the ESP string (112). The pump intake (130) is the section of the ESP string (112) where the fluid (102) enters the ESP string (112) from the annulus (128).

The pump intake (130) is located above the motor protectors (120) and below the pump (124). The depth of the pump intake (130) is designed based off of the formation (104) pressure, estimated height of the fluid (102) in the annulus (128), and optimization of pump (124) performance. If the fluid (102) has associated gas, then a gas separator (122) may be installed in the ESP string (112) above the pump intake (130) but below the pump (124). The gas separator (122) removes the gas from the fluid (102) and injects the gas (depicted as separated gas (132) in FIG. 1) into the annulus (128).

The pump (124) is located above the gas separator (122) and lifts the fluid (102) to the surface location (114). The pump (124) has a plurality of stages that are stacked upon one another. Each stage contains a rotating impeller and stationary diffuser. As the fluid (102) enters each stage, the fluid (102) passes through the rotating impeller to be centrifuged radially outward gaining energy in the form of velocity. The fluids (102) enter the diffuser, and the velocity is converted into pressure. As the fluid (102) passes through each stage, the pressure continually increases until the fluid (102) obtains the designated discharge pressure and has sufficient energy to flow to the surface location (114). The ESP string (112) outlined in FIG. 1 may be described as a standard ESP string (112), however, the term ESP string (112) may be referring to a standard ESP string (112) or an inverted ESP string (112) without departing from the scope of the disclosure herein.

In other embodiments, sensors may be installed in various locations along the ESP string (112) to gather downhole data such as pump intake (130) pressures, discharge pressures, and temperatures. The number of stages is determined prior to installation based of the estimated required discharge pressure. Over time, the formation (104) pressure may decrease and the height of the fluid (102) in the annulus (128) may decrease. In these cases, the ESP string (112) may be removed and resized. Once the fluid (102) reaches the surface location (114), the fluid (102) flows through the wellhead (134) into production equipment (136). The production equipment (136) may be any equipment that can gather or transport the fluids (102) such as a pipeline or a tank.

The ESP system (100) may include a SSSV (142) installed within the ESP string (112). The SSSV (142) may be installed near the surface location (114). The SSSV (142) is a valve, such as a flapper valve, that may be used to block the fluid (102) from flowing up the ESP string (112) and to the surface location (114). The SSSV (142) may be used as part of the shut-in system of the well (116). In scenarios where the well (116) needs to be shut in, such as for repairs or in an emergency, the SSSV (142) along with other valves located in the wellhead (134) are closed. The SSSV (142) may be controlled using a SSSV control line (144). The SSSV control line (144) may connect the SSSV (142) to a control module at the surface location (114). The SSSV control line (144) may be a conduit for hydraulic fluid. The control module may use the hydraulic fluid within the SSSV control line (144) to open or close the SSSV (142).

The remainder of the ESP system (100) includes various surface equipment (110) such as electric drives (137), pump control equipment (138), the control module, and an electric power supply (140). The electric power supply (140) provides energy to the motor (118) through the electrical cable (126). The electric power supply (140) may be a commercial power distribution system or a portable power source such as a generator. The pump control equipment (138) is made up of an assortment of intelligent unit-programmable controllers and drives which maintain the proper flow of electricity to the motor (118) such as fixed-frequency switchboards, soft-start controllers, and variable speed controllers. The electric drives (137) may be variable speed drives which read the downhole data, recorded by the sensors, and may scale back or ramp up the motor (118) speed to optimize the pump (124) efficiency and production rate. The electric drives (137) allow the pump (124) to operate continuously and intermittently or be shut-off in the event of an operational problem.

CDESP systems, as one skilled in the art will be aware, are rigless ESP systems (100) that are designed to bring wells (116) on production faster and lower the costs associated with installing and replacing ESP systems (100). CDESP systems feature an inverted ESP system (100) with the motor (118) connected directly to an electrical cable (126) configuration, which improves the overall reliability of the system.

In CDESP systems, a SSSV (142) set below the bottomhole assembly, or a deep-set SSSV (142), may be employed. Drawbacks of the deep-set SSSV (142) may include the requirement of long control lines (144) and the need to replace surface control panels already in place when converting wells (116) from a typical tubing deployed ESP system (100) to a CDESP system.

An alternative to the deep-set SSSV (142) is a shallow-set SSSV (142). The application of a shallow-set SSSV (142) is complicated by the electrical cable (126) in the production stream which must seal against the flow of fluid (102) to the surface location (114). In addition, the use of a shallow-set SSSV (142) complicates the deployment and retrieval of the CDESP system, especially under live well (116) conditions. Still, new solutions which use a CDESP system to operate the SSSV (142) without control lines (144) from the surface location (114) are becoming available. However, these designs suffer from sand production and accumulation issues. Flow tubes (146) and springs (148) of these designs may become jammed by sand disposed within the fluid (102), preventing proper functionality of the SSSV (142). As such, embodiments disclosed herein present systems (150) and methods of operating a SSSV (142). In addition, the systems (150) and methods include an ESP (152) composed of a pump (124), a pump intake (130), and a pump discharge (154). Further, a flow regulating valve (156) of the systems (150) and methods is formed of a flow tube (146), a piston (158), a stinger (160), a spring (148), and a plurality of seals (162). The system (150) prevents sand accumulation, thereby ensuring proper functionality.

Figure 2:
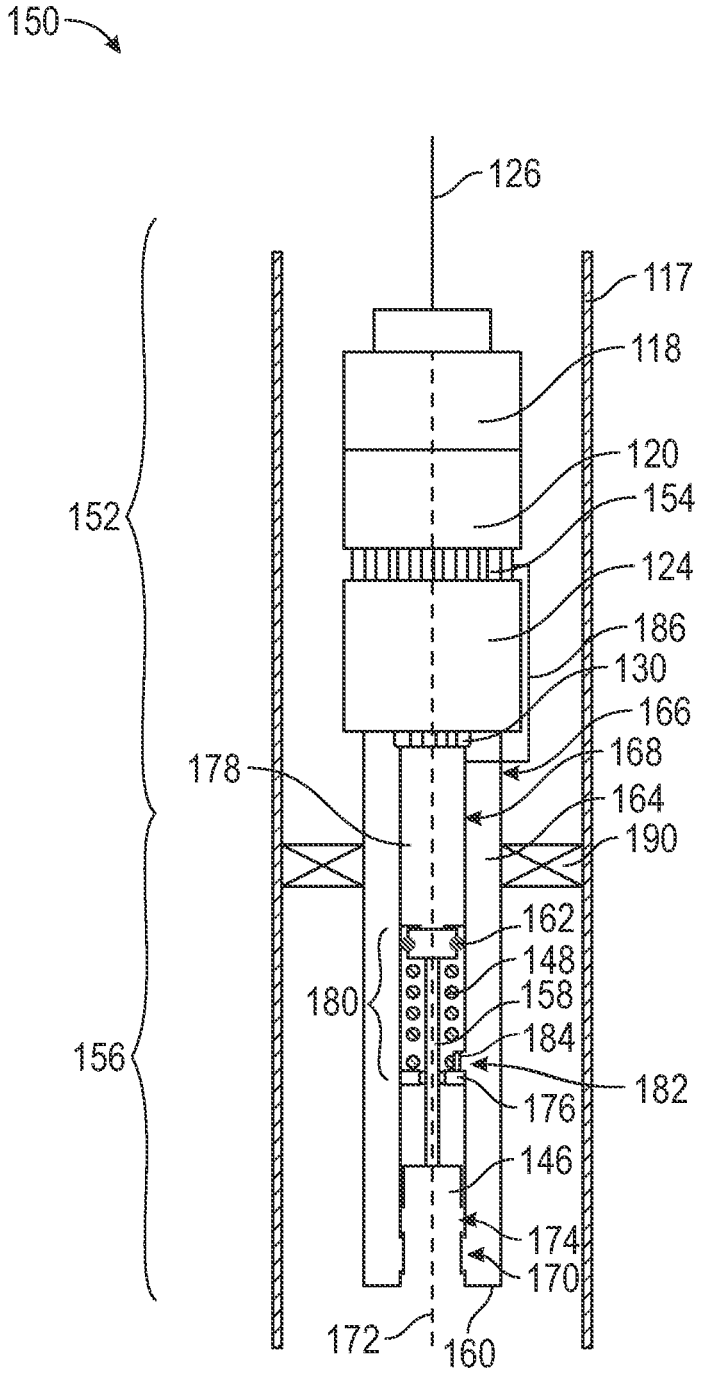
FIG. 2 shows a cross-sectional view of a system in accordance with one or more embodiments of the present disclosure.

FIG. 2 shows a cross-sectional view of the system (150) in accordance with one or more embodiments of the present disclosure. The system (150) includes an ESP (152) and a flow regulating valve (156). Here, the ESP (152) is formed of a pump (124), a pump intake (130), and a pump discharge (154). In this embodiment, the ESP (152) is a CDESP system and includes a motor (118) connected directly to an electrical cable (126) configuration. As described above, when activated, the pump (124) of the ESP (152) receives a fluid (102) disposed in the production tubing (117) of the well (116) through the pump intake (130) and vents the fluid (102) through the pump discharge (154) to the surface location (114).

The flow regulating valve (156) includes a stinger (160), a flow tube (146), a piston (158), a spring (148), and a plurality of seals (162). An upper end of the stinger (160) of the flow regulating valve (156) may be connected to the ESP (152). When joined together, the flow regulating valve (156) is disposed downhole of the ESP (152). The stinger (160) includes a conduit (164) for the fluid (102) to flow from the production tubing (117) of the well (116) to the pump intake (130). Further, the stinger (160) is tubularly shaped and may be formed of an outer pipe (166) and an inner pipe (168). Additionally, the stinger (160) may include upper and lower surfaces connecting the outer pipe (166) and inner pipe (168). The conduit (164) of the stinger (160) is disposed between the outer pipe (166) and the inner pipe (168). In general, the stinger (160) is formed of steel and may further include intake slots (170). The intake slots (170) are located on the inner pipe (168) at a downhole end of the stinger (160). The downhole end of the stinger (160) is an end of the stinger (160) including the lower surface. The intake slots (170) are openings of the stinger (160) which permit the fluid (102) from the production tubing (117) of the well (116) to enter the conduit (164) of the stinger (160). Also, the stinger (160) may be fixed to the ESP (152) by attaching the upper surface of the stinger (160) to the pump (124) and by attaching the inner pipe (168) of the stinger (160) to the pump intake (130).

The flow tube (146) of the flow regulating valve (156) is disposed within an interior of the stinger (160), defined by the space inside the inner pipe (168) of the stinger (160). The flow tube (146) is tubularly shaped and may be formed of a durable material, such as a hard polymer or steel. In addition, the flow tube (146) is moveable within the interior of the stinger (160) along a central axis (172) of the system (150) and includes ports (174) that may align with the intake slots (170) of the stinger (160). The ports (174) are openings for fluid (102) to flow through. Hydraulic communication between the stinger (160) and the flow tube (146) is established when the flow tube (146) is moved into a position such that the ports (174) and the intake slots (170) of the stinger (160) align. However, when the flow tube (146) is moved into a position such that the ports (174) and intake slots (170) do not align, the exterior surface of the flow tube (146) covers the intake slots (170) of the stinger (160) such that hydraulic communication between the stinger (160) and flow tube (146) is lost and fluid (102) from the production tubing (117) of the well (116) is unable to enter the stinger (160). Further, an upper surface of the flow tube (146) is attached to the piston (158).

The piston (158) of the flow regulating valve (156) is also disposed within the interior of the stinger (160), above the flow tube (146). In the embodiment depicted in FIG. 2, the piston (158) is formed of a shaft rigidly fixed to a disk. The shaft and the disk may both be formed of a similar, durable material such as steel. The disk is situated at the upper end of the piston (158) and may have a diameter slightly less than the diameter of the interior of the stinger (160). The shaft is disposed downhole of the disk. The downhole end of the shaft is fixed to the upper surface of the flow tube (146). In this way, the flow tube (146) is connected to the downhole end of the piston (158). Accordingly, the piston (158) is designed to move the flow tube (146) within the flow regulating valve (156).

When the pump (124) is inactive, the piston (158) is positioned within the flow regulating valve (156) by a spring (148). The spring (148) is configured to move the piston (158) along the central axis (172) of the system (150). In this particular embodiment, the spring (148) is a compression spring (148) and may be formed of high-carbon, alloy, or stainless steel. The spring (148) may act upon the downhole end of the disk of the piston (158), thereby moving the piston (158) within the flow regulating valve (156) towards the surface location (114). In addition, the shaft of the piston (158) may be disposed through the central opening of the spring (148). The spring (148) is supported by and fixed to a spring support (176) disposed within the interior of the stinger (160). The spring support (176) limits the downhole movement of the piston (158). Further, the spring support (176) may be a steel disk fixed to the inner pipe (168) of the stinger (160) within the interior of the stinger (160) and includes an opening in its center that the shaft of the piston (158) may pass through.

The plurality of seals (162) of the flow regulating valve (156) may be formed of rubber or an elastomer. In this embodiment, a seal (162) may be disposed between the disk of the piston (158) and the inner pipe (168) of the stinger (160). Here, the seal (162) pressure-seals a pressure chamber (178) of the flow regulating valve (156). The pressure chamber (178) is a space between the upper end of the piston (158) and the pump (124). In the embodiment depicted in FIG. 2, the pressure chamber (178) is disposed within the interior of the stinger (160) between the pump intake (130) and the piston (158).

Further, a cavity (180) is situated between the upper end of the piston (158) and the spring support (176). The spring (148) is disposed within the cavity (180). The cavity (180) may also include communication ports (182). The communication ports (182) are openings along the inner pipe (168) of the stinger (160) within the cavity (180) which establish hydraulic communication between the cavity (180) and the conduit (164) of the stinger (160), and thus, the pump intake (130). In addition, the communication ports (182) relieve pressure built inside the cavity (180) as the piston (158) moves within the cavity (180).

The system (150) may further include a sand screen (184) to filter sand produced with the fluid (102). In this embodiment, a sand screen (184) is disposed at the communication ports (182) of the cavity (180), thereby preventing sand from entering the cavity (180). In this way, sand is prevented from settling inside the cavity (180) and potentially restricting the movement of the spring (148) and the piston (158).

In addition, the system (150) may include a capillary tube (186). The capillary tube (186) is a tube that may be formed of flexible material, such as an elastomer, or of a durable material, such as stainless steel. Hydraulic communication is provided between the pump discharge (154) and the pressure chamber (178) by the capillary tube (186) in this embodiment. In this way, the capillary tube (186) transports a discharge pressure of the pump (124) of the ESP (152) to the pressure chamber (178) of the flow regulating valve (156). When the capillary tube (186) transfers the discharge pressure to the pressure chamber (178), pressure within the pressure chamber (178) increases. Consequently, the increasing discharge pressure within the pressure chamber (178) applies a pressure force to the upper end of the piston (158), thereby pushing the piston (158) downhole. Accordingly, the flow tube (146) moves downhole as the piston (158) is forced downhole, and the spring (148) is compressed. In addition, the capillary tube (186) may be filled with a hydraulic fluid in order to prevent sand from plugging the capillary tube (186).

Furthermore, the system (150) may include a packer (190). The packer (190) creates a fluid-tight seal between the outer pipe (166) of the stinger (160) and the production tubing (117) in order to provide isolation between the fluid (102) entering the pump intake (130) of the ESP (152) and the fluid (102) exiting the pump discharge (154). In this way, the packer (190) prevents fluid recirculation within the system (150).

Figure 3A:
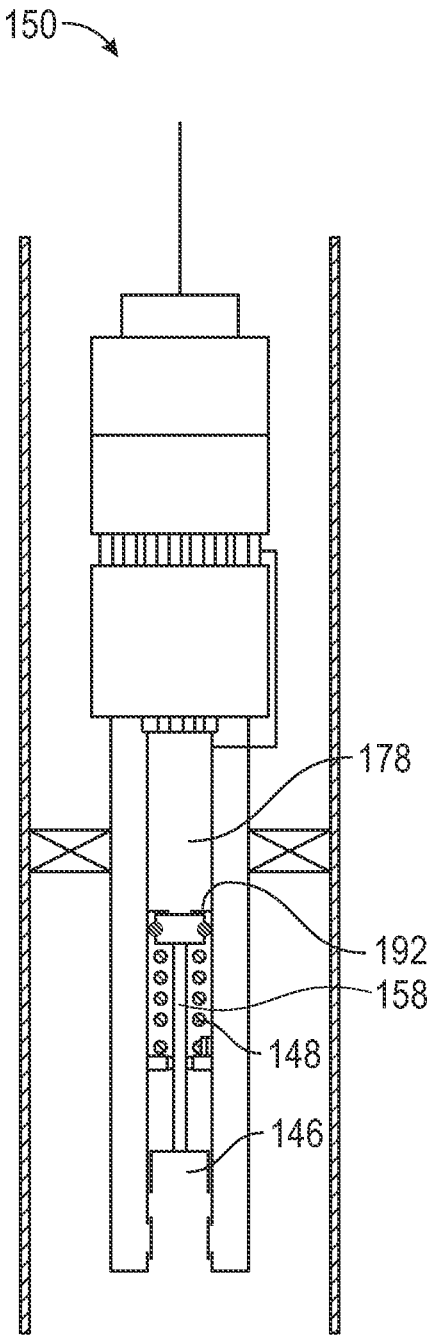
FIGS. 3A and 3B show diagrams depicting the operational sequence of the system in accordance with one or more embodiments.
Figure 3B:
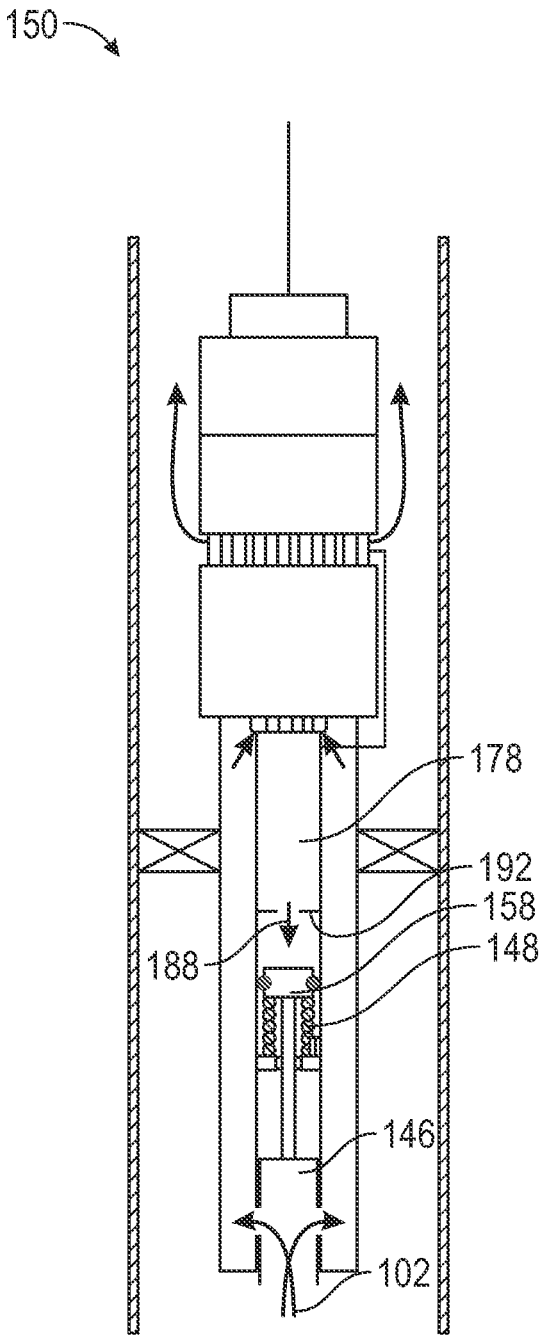

FIGS. 3A and 3B show diagrams depicting the operational sequence of the system (150) in accordance with one or more embodiments. In particular, FIG. 3A shows the system (150) when the pump (124) of the ESP (152) is inactive. Here, the spring (148) of the flow regulating valve (156) is expanded and applies a force upwards upon the piston (158). Consequently, the disk of the piston (158) is forced against a stopper (192). The stopper (192) may be a disk or rods fixed to the inner pipe (168) of the stinger (160), protruding from the inner pipe (168) towards the interior of the stinger (160). The stopper (192) may be formed of a durable material such as steel and limits the upwards movement of the piston (158).

In addition, when the piston (158) rests against the stopper (192), the ports (174) of the flow tube (146) and the intake slots (170) of the stinger (160) are not aligned. In the embodiment shown, the ports (174) of the flow tube (146) are located above the intake slots (170) of the stinger (160) in this position. Therefore, the exterior of the downhole end of the flow tube (146) covers the intake slots (170) of the stinger (160), thereby preventing fluid (102) disposed in the production tubing (117) of the well (116) from entering the conduit (164) of the stinger (160).

FIG. 3B shows the system (150) when the pump (124) of the ESP (152) is active. When the pump (124) is activated, the pump discharge (154) supplies a discharge pressure (188) to the pressure chamber (178) of the flow regulating valve (156) through a capillary tube (186) of the system (150). The pressure within the pressure chamber (178) continually increases due to the addition of the discharge pressure (188) from the pump discharge (154) until the pressure is great enough to force the piston (158) downwards within the flow regulating valve (156). The piston (158) is forced downwards when a pressure force of the discharge pressure (188) pushing downwards on the disk of the piston (158) is greater than a spring force of the spring (148) pushing upwards on the disk. When the spring (148) is fully compressed by the discharge pressure (188) that has been added to the pressure chamber (178), the piston (158) and, thus, the flow tube (146) are positioned within the flow regulating valve (156) such that the ports (174) of the flow tube (146) align with the intake slots (170) of the stinger (160).

With the intake slots (170) of the stinger (160) and the ports (174) of the flow tube (146) aligned, hydraulic communication between the conduit (164) of the stinger (160) and an interior of the flow tube (146) is established. In this way, the pump intake (130) and the production tubing (117) of the well (116) are also in hydraulic communication. Therefore, a suction force produced by the pump (124) of the ESP (152) causes the fluid (102) from within the production tubing (117) to enter the flow tube (146), pass through the ports (174) and intake slots (170), travel upwards within the conduit (164), and enter the pump intake (130). From the pump intake (130), the fluid (102) flows upwards through the pump (124) to the pump discharge (154). The pump discharge (154) then vents the fluid (102) into the production tubing (117) above the packer (190). In turn, the fluid (102) travels upwards in the production tubing (117) to the surface location (114) to be produced.

Figure 4:
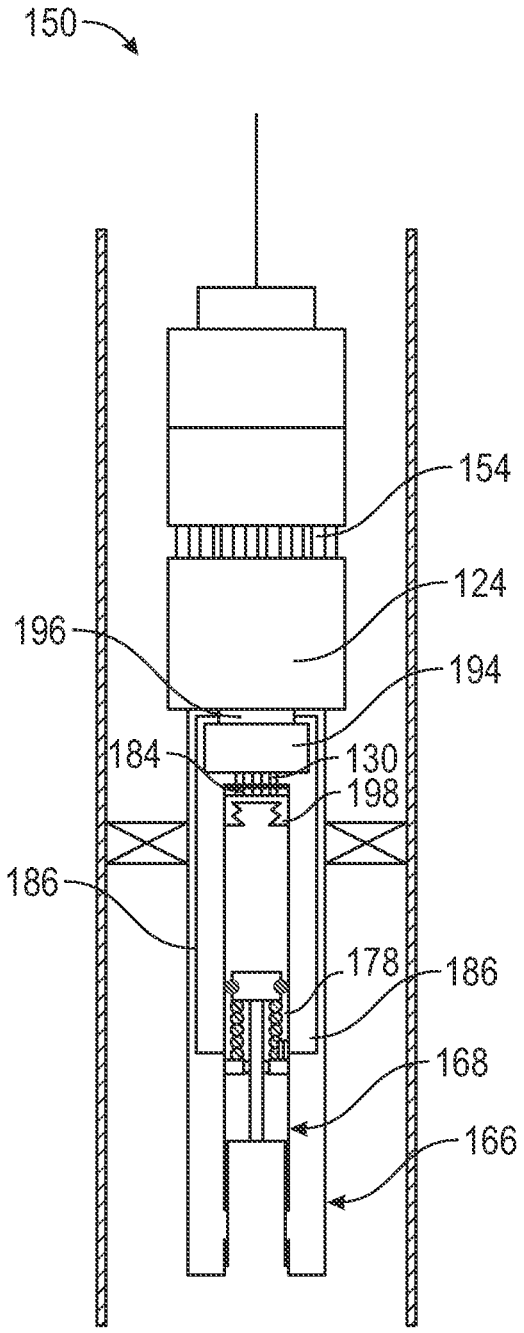
FIG. 4 shows a cross-sectional view of a system in accordance with one or more embodiments of the present disclosure.

FIG. 4 shows a cross-sectional view of the system (150) in accordance with one or more embodiments of the present disclosure. In this embodiment of the system (150), the ESP (152) includes a secondary pump (194). The secondary pump (194) is employed to provide a pressure differential within the system (150). This pressure differential is utilized to move the piston (158) and flow tube (146) within this embodiment of the system (150). The secondary pump (194) is situated between the pump (124) and the pump intake (130), with the pump intake (130) being connected to the downhole end of the secondary pump (194). Further, the secondary pump (194) and the pump intake (130) are displaced above the inner pipe (168) of the stinger (160), within the outer pipe (166). In addition, the secondary pump (194) includes a secondary pump discharge (196). The secondary pump discharge (196) is disposed between the secondary pump (194) and the pump (124) and transfers the fluid (102) entering the secondary pump (194) through the pump intake (130) to the pump (124).

The pressure differential is created by a discharge pressure (188) being pumped into the cavity (180) of the flow regulating valve (156) by the secondary pump discharge (196). The secondary pump discharge (196) is connected to the cavity (180) by capillary tubes (186). In this way, the pressure chamber (178) is disposed within the cavity (180) of the flow regulating valve (156) for the embodiment depicted in FIG. 4.

Further, the secondary pump discharge (196) may include a sand screen (184) to prevent sand from accumulating within the capillary tubes (186). In addition, sand may be prevented from migrating within the interior of the stinger (160) above the piston (158) by a bellow (198). The bellow (198) may be formed of rubber, conically shaped, and disposed between the pump intake (130) and the interior of the stinger (160). An additional sand screen (184) may be included above the bellow (198) in order to prevent sand from accumulating and settling above the below (198).

Figure 5A:
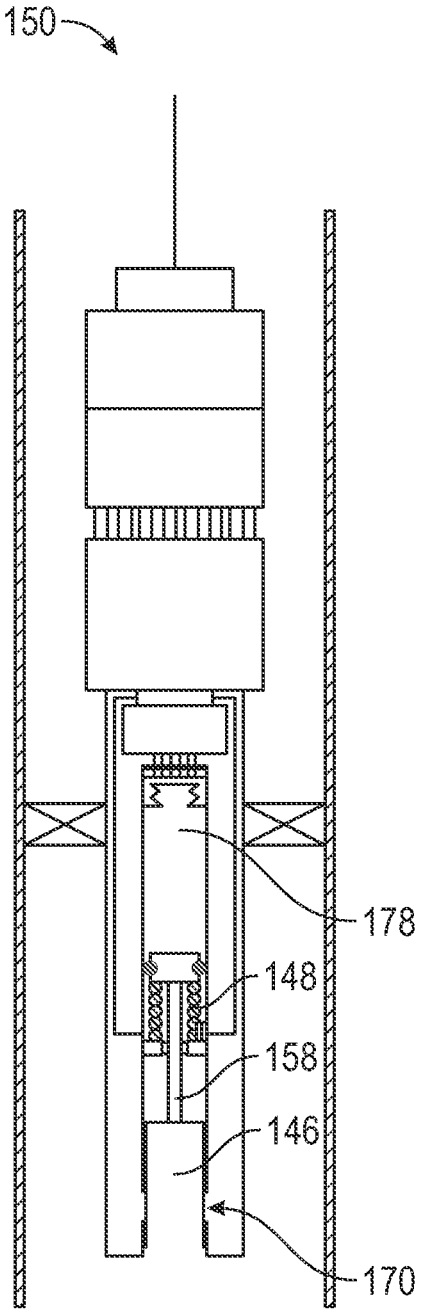
FIGS. 5A and 5B show diagrams depicting the operational sequence of the system in accordance with one or more embodiments.
Figure 5B:
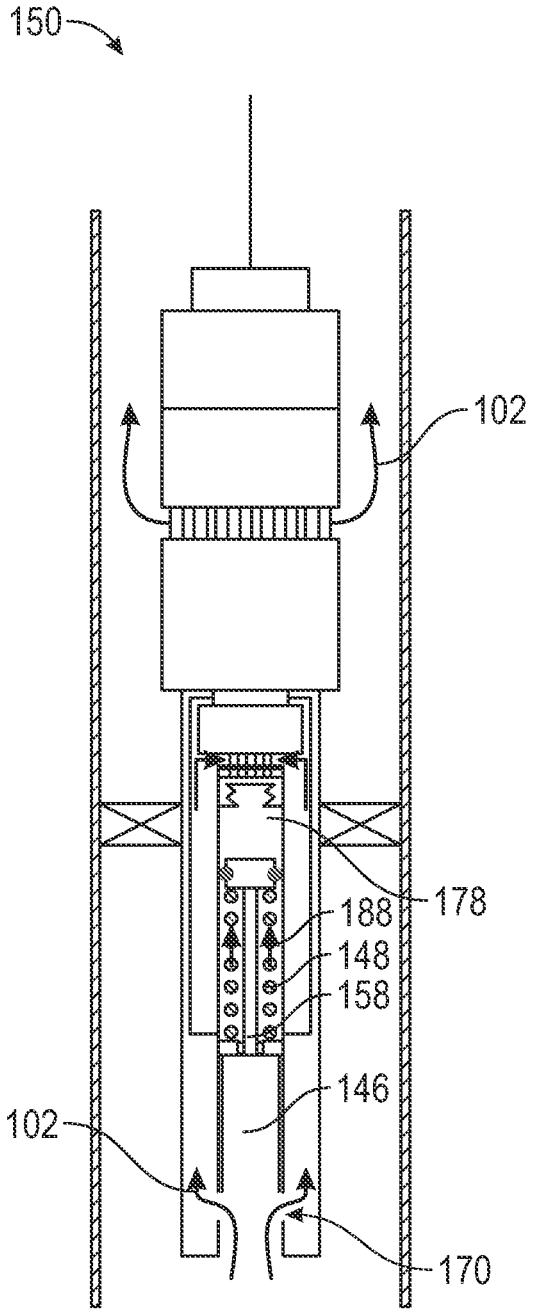

FIGS. 5A and 5B show diagrams depicting the operational sequence of the system (150) in accordance with one or more embodiments. In particular, FIG. 5A shows the system (150) when the pump (124) and secondary pump (194) of the ESP (152) are inactive. In this embodiment, the spring (148) is compressed between the spring support (176) and the piston (158) and applies a force downwards on the piston (158). Consequently, the piston (158) and flow tube (146) are positioned such that the exterior of the flow tube (146) covers the intake slots (170) of the stinger (160), thereby blocking the fluid (102) from entering the conduit (164) of the stinger (160).

FIG. 5B shows the system (150) when the pump (124) and the secondary pump (194) of the ESP (152) are active. Shafts of the pump (124) and the secondary pump (194) are coupled together, and therefore, the pump (124) and the secondary pump (194) activated simultaneously. When the pump (124) and secondary pump (194) are activated, the secondary pump discharge (196) supplies a discharge pressure (188) to the cavity (180) of the flow regulating valve (156) through the capillary tubes (186) in order to create the pressure differential. The cavity (180) and the interior of the stinger (160) above the piston (158) may be filled with a hydraulic fluid. In addition, the capillary tubes (186) may be filled with the hydraulic fluid, which prevents sand from plugging the capillary tubes (186). The hydraulic fluid may be pumped into the cavity (180) through the capillary tube (186) by the secondary pump discharge (196). In this way, the pressure within the cavity (180) increases. As the pressure increases within the cavity (180), a pressure force pushes upwards on the disk of the piston (158). When the pressure force created by the pressure within the cavity (180) exceeds the spring force of the spring (148), the piston (158) travels upwards within the interior of the stinger (160), thereby expanding the spring (148). When the spring (148) is fully expanded by the discharge pressure (188), the flow tube (146) is positioned within the flow regulating valve (156) such that the exterior of the flow tube (146) no longer covers the intake slots (170) of the stinger (160). In this non-limiting example, the flow tube (146) does not include ports (174). Instead, the intake slots (170) of the stinger (160) come into hydraulic communication with the downhole end of the interior of the stinger (160) subsequent to the flow tube (146) being raised above the intake slots (170).

Once the flow tube (146) uncovers the intake slots (170), the conduit (164) of the stinger (160) and production tubing (117) are in hydraulic communication. Accordingly, a suction force produced by the secondary pump (194) forces the fluid (102) to travel from the production tubing (117) into the conduit (164) of the stinger (160). The fluid (102) then enters the pump intake (130) from the conduit (164). Subsequently, the fluid (102) is pumped through the secondary pump (194) and secondary pump discharge (196) into the pump (124). The pump (124) then guides the fluid (102) to the pump discharge (154) where the fluid (102) is vented into the production tubing (117) to be received and produced at the surface location (114).

Figure 6:
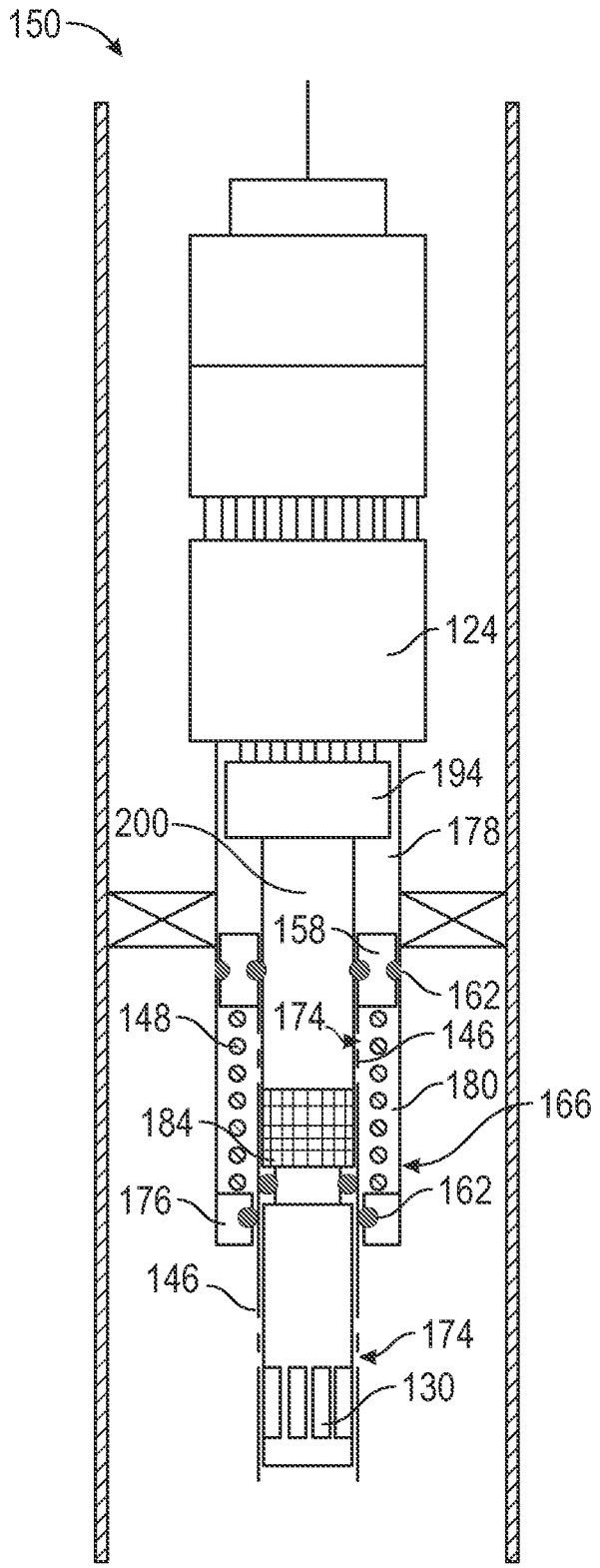
FIG. 6 shows a cross-sectional view of a system in accordance with one or more embodiments of the present disclosure.

FIG. 6 shows a cross-sectional view of the system (150) in accordance with one or more embodiments of the present disclosure. Similar to FIG. 4, the system (150) includes a secondary pump (194) and secondary pump discharge (196). However, in this embodiment of the system (150), the pump intake (130) of the ESP (152) includes a pump intake tube (200). The pump intake tube (200) is designed to be a passage for the fluid (102) to pass from the pump intake (130) to the secondary pump (194) and may extend from the pump intake (130) to the secondary pump (194). Further, the pump intake tube (200) may be formed of a durable material such a steel or a hard polymer.

In the non-limiting example depicted in FIG. 6, the stinger (160) only includes an outer pipe (166). In this way, the interior of the stinger (160) is defined by the space inside the outer pipe (166) and the conduit (164) is formed between the outer pipe (166) and the pump intake tube (200). Here, the pump intake tube (200) extends from the pump intake (130) to the secondary pump (194) through the interior of the stinger (160). Further, the pump intake tube (200) may include a sand screen (184). The sand screen (184) is utilized to prevent sand from migrating into the cavity (180).

In addition, in this embodiment, the pump intake (130) extends from the interior of the stinger (160) into the production tubing (117) of the well (116). Consequently, the flow tube (146) also extends from the stinger (160) into the production tubing (117). In this way, the exterior of the flow tube (146) may cover the pump intake (130) in order to block fluid (102) from entering the pump intake (130), or the ports (174) of the flow tube (146) may align with the pump intake (130), thereby permitting fluid (102) to enter the pump intake (130). The upper end of the flow tube (146) is attached to the piston (158) and disposed within the interior of the stinger (160).

In this embodiment, the stinger (160) does not include a lower surface. Instead, the spring support (176) is disposed between the flow tube (146) and the outer pipe (166). Further, a seal (162) may be located between the spring support (176) and the flow tube (146) or the outer pipe (166). In this way, the spring support (176) and the seal (162) prevent the fluid (102) disposed within the production tubing (117) from entering the downhole end of the stinger (160).

The conduit (164) of the stinger (160) houses the piston (158) and spring (148) in this embodiment. The upper and downhole ends of the spring (148) are attached to the piston (158) and spring support (176), respectively. Here, the piston (158) is annularly shaped with an opening at its center. In this way, the piston (158) may move within the conduit (164) of the stinger (160). A seal (162) may be situated between the piston (158) and the pump intake tube (200). Further, a seal (162) may be situated between the piston (158) and the outer pipe (166). The plurality of seals (162) are utilized to pressure-seal the pressure chamber (178). In this embodiment, the pressure chamber (178) is located in the conduit (164) above the piston (158).

Furthermore, in this embodiment, the upper end of the flow tube (146) includes ports (174). When the flow tube (146) is positioned such that the ports (174) located at the downhole end of the flow tube (146) align with the pump intake (130), the ports (174) disposed at upper end of the flow tube (146) align with the sand screen (184) of the pump intake tube (200). In this position, the cavity (180) and the pump intake tube (200) are in hydraulic communication. However, when the flow tube (146) is positioned such that the ports (174) located at the downhole end of the flow tube (146) are not aligned with the pump intake (130), the ports (174) disposed at upper end of the flow tube (146) are also not aligned with the sand screen (184) of the pump intake tube (200). In turn, the cavity (180) and the pump intake tube (200) are not in hydraulic communication while in this position.

Figure 7A:
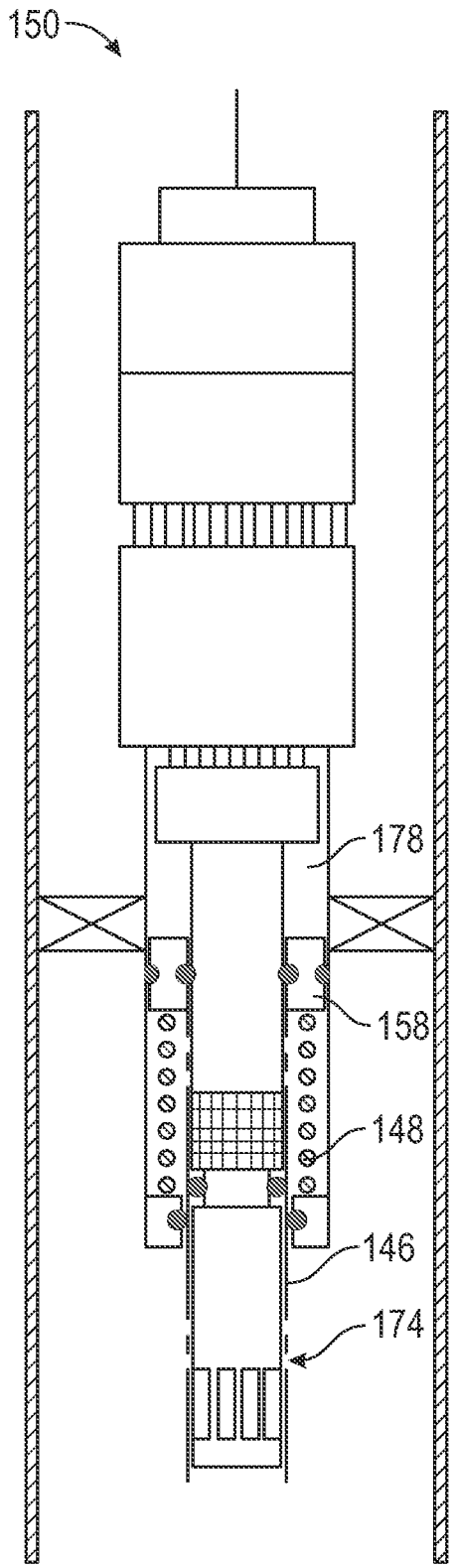
FIGS. 7A and 7B show diagrams depicting the operational sequence of the system in accordance with one or more embodiments.
Figure 7B:
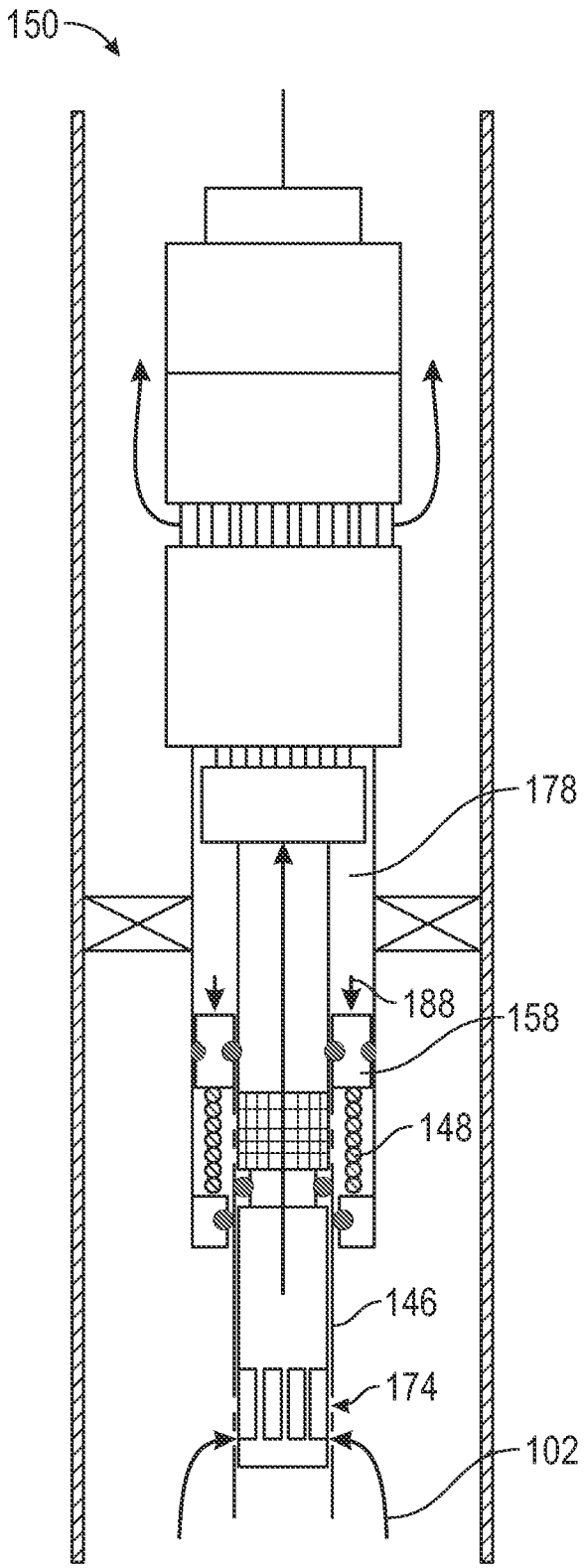

FIGS. 7A and 7B show diagrams depicting the operational sequence of the system (150) in accordance with one or more embodiments. Specifically, FIG. 7A shows the system (150) when the pump (124) and secondary pump (194) of the ESP (152) are inactive. In this embodiment, the spring (148) is expanded and applies a force upwards upon the piston (158). Accordingly, the attached flow tube (146) is positioned by the piston (158), such that the ports (174) of the flow tube (146) and the pump intake (130) are not aligned. Therefore, the exterior of the flow tube (146) covers the pump intake (130) and prevents the fluid (102) disposed in the production tubing (117) from entering the pump intake (130).

FIG. 7B shows the system (150) when the pump (124) and the secondary pump (194) of the ESP (152) are active. When the pump (124) and secondary pump (194) are activated, the secondary pump (194) and secondary pump discharge (196) supply a discharge pressure (188) into the pressure chamber (178). As the pressure within the conduit (164) above the piston (158) builds, a pressure force pushing downward on the piston (158) increases. Eventually, the pressure force overcomes the spring force, compressing the spring (148) and moving the piston (158) downhole within the conduit (164).

When the spring (148) is fully compressed, the piston (158), and thus, the flow tube (146) are in a position such that the ports (174) of the flow tube (146) are aligned with the pump intake (130). Consequently, fluid (102) disposed within the production tubing (117) is drawn into the pump intake (130). A suction force created by the secondary pump (194) forces the fluid (102) to flow from the pump intake (130) into the pump intake tube (200). Upon reaching the secondary pump (194), the fluid (102) is pumped through the secondary pump discharge (196) into the pump (124). Accordingly, the fluid (102) is vented from the pump discharge (154) into the production tubing (117). The fluid (102) then travels within the production tubing (117) towards the surface location (114) to be produced.

Figure 8:
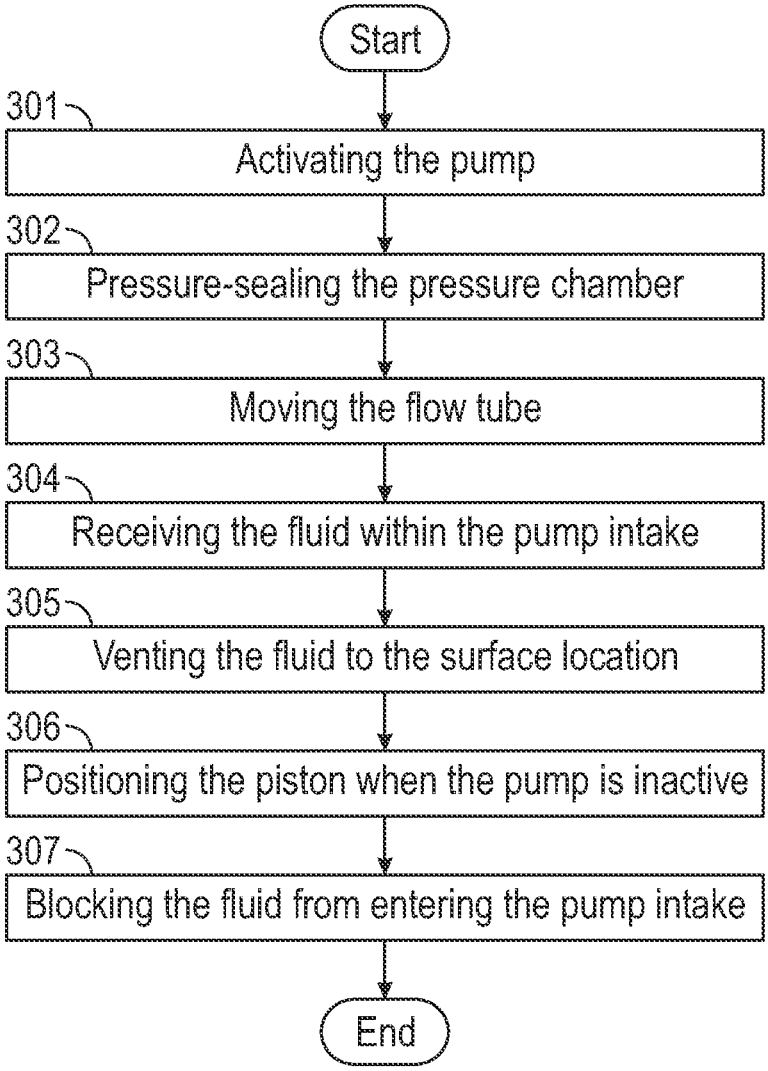
FIG. 8 shows a flowchart of a method in accordance with one or more embodiments of the present disclosure.

FIG. 8 depicts a flowchart of a method in accordance with one or more embodiments of the present disclosure. While the various flowchart blocks in FIG. 8 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 301, the pump (124) of the ESP (152) is activated. In some embodiments, subsequent to the activation of the pump (124), the pump discharge (154) may supply a discharge pressure (188) to the pressure chamber (178) of the flow regulating valve (156). The pressure chamber (178) is disposed between the piston (158) and the pump (124) and may be disposed within the interior of the flow tube (146) or the conduit (164) of the stinger (160), depending on the location of the piston (158). In other embodiments, the pump discharge (154) may supply a discharge pressure (188) to the cavity (180) of the flow regulating valve (156).

Prior to the pump (124) being activated, a packer (190) may be set inside the production tubing (117). The ESP (152) may then be deployed into the well (116) using a specially designed electrical cable (126) configuration. Accordingly, the ESP (152) stings into the packer (190) which isolates the pump discharge (154) from the pump intake (130), thereby preventing fluid recirculation within the system (150).

In block 302, the pressure chamber (178) and cavity (180) are pressure-sealed by the plurality of seals (162). A plurality of seals (162) may be disposed between the piston (158) and the inner pipe (168) of the stinger (160) if the piston (158) is disposed within the interior of the stinger (160). If the piston (158) is disposed within the conduit (164) of the stinger (160), then a plurality of seals (162) may be disposed between the piston (158) and the pump intake tube (200), as well as the piston (158) and the outer pipe (166). The plurality of seals (162) prevent the discharge pressure (188) from exiting the pressure chamber (178) or the cavity (180). In this way, pressure may build within the pressure chamber (178) or the cavity (180).

In block 303, the discharge pressure within the pressure chamber (178) or the cavity (180) forces the piston (158) to move within the flow regulating valve (156). That is, a pressure force acting upon the piston (158) due to the pressure build-up within the pressure chamber (178) or the cavity (180) exceeds the spring force, thereby forcing the piston (158) to move. If the pressure force causes the piston (158) to move downhole within the flow regulating valve (156), the spring (148) may compress, and if the pressure force moves the piston (158) upwards within the flow regulating valve (156), the spring (148) may expand. Consequently, as the piston (158) moves, the flow tube (146) attached to the piston (158) also moves in the same direction.

In block 304, the spring (148) of the flow regulating valve (156) may be fully compressed. Accordingly, in some embodiments, when the spring (148) is fully compressed, the flow tube (146) may be positioned such that the ports (174) of the flow tube (146) align with the intake slots (170) of the stinger (160). In this way, the flow tube (146) and the conduit (164) of the stinger (160) are in hydraulic communication. Here, a suction force created by the pump (124) may cause the fluid (102) disposed in the production tubing (117) to pass through the flow tube (146), into the conduit (164), and head towards the pump intake (130).

Further, in other embodiments, when the spring (148) is fully compressed, the flow tube (146) may be positioned such that the ports (174) align with the pump intake (130).

Here, direct hydraulic communication between the pump intake (130) and the production tubing (117) is established. Therefore, the fluid (102) disposed within the flow tube (146) is drawn into the pump intake (130). Subsequently, the fluid (102) may pass from the pump intake (130) to a secondary pump (194) through a pump intake tube (200).

In other embodiments, when the spring (148) is fully expanded by the discharge pressure (188), the flow tube (146) may be positioned such that the exterior of the flow tube (146) is above and no longer covering the intake slots (170) of the stinger (160). In this way, the conduit (164) of the stinger (160) is in hydraulic communication with the production tubing (117). Therefore, fluid (102) may pass from the production tubing (117) to the pump intake (130) through the conduit (164).

In block 305, the fluid (102) may be pumped directly from the pump intake (130) through the pump (124) and into the pump discharge (154). In other embodiments, the fluid (102) may travel from the pump intake (130) into a secondary pump (194) and a secondary pump discharge (196) prior to entering the pump (124). Once at the pump discharge (154), the fluid (102) is vented into the production tubing (117) above the packer (190). Upon exiting the system (150), the fluid (102) travels upwards in the well (116) towards the surface location (114) to be produced.

In block 306, after completion of the pumping operation, the pump (124) and the secondary pump (194) are turned off. When the pump (124) and secondary pump (194) are no longer active, the suction force created by the pump (124) or secondary pump (194) is diminished, and thus, the fluid (102) is no longer drawn upwards within the system (150). In addition, when the pump (124) and secondary pump (194) are inactive, the discharge pressure (188) is no longer added into the pressure chamber (178) or the cavity (180). Consequently, the pressure within the pressure chamber (178) or the cavity (180) reduces. In turn, the spring force becomes greater than the pressure force pressing against the piston (158) created by the discharge pressure (188), and thus, the spring (148) may return the piston (158) to its initial position.

In block 307, the spring (148) has repositioned the piston (158) within the flow regulating valve (156). Accordingly, when the spring (148) and piston (158) come to rest, the piston (158), and thus, the flow tube (146) are positioned such that the exterior of the flow tube (146) is covering the intake slots (170) of the stinger (160). In other embodiments, the exterior of the flow tube (146) may be covering the pump intake (130) in this position. Consequently, fluid (102) disposed within the production tubing (117) is blocked from entering the system (150) as hydraulic communication between the pump intake (130) and production tubing (117) is lost. The system (150) may then be operated again or removed from the well (116).

Accordingly, the aforementioned embodiments as disclosed relate to systems (150) and methods useful for operating a SSSV (142). The disclosed systems (150) for and methods of operating a SSSV (142) advantageously simplify operational deployment and retrieval challenges associated with CDESP systems. This benefit, in turn, advantageously reduces rig time and associated costs. In addition, the disclosed systems (150) for and methods of operating a SSSV (142) advantageously reduce sand accumulation within ESP systems (100).

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A system comprising:

an electric submersible pump comprising a pump that, when activated, receives a fluid disposed within a production tubing of a well through a pump intake and vents the fluid through a pump discharge to a surface location; and a flow regulating valve comprising:

a flow tube configured to block the fluid from entering the pump intake when the pump is inactive;

a piston, connected to the flow tube, configured to move the flow tube within the flow regulating valve;

a stinger having a conduit for the fluid to flow from the production tubing to the pump;

a spring configured to position the piston within the flow regulating valve when the pump is inactive; and a plurality of seals configured to pressure-seal a pressure chamber configured to house a pressure force that is to be applied upon the piston;

wherein the spring is disposed within a cavity bounded between an upper end of the piston and a spring support, wherein the spring abuts and is configured to act upon the piston and the spring is supported by and fixed to the spring support.

2. The system according to claim 1, wherein the electric submersible pump is a cable deployed electric submersible pump.

3. The system according to claim 1, wherein the stinger is connected to the electric submersible pump.

4. The system according to claim 1, wherein the stinger comprises intake slots to receive the fluid from the production tubing.

5. The system according to claim 4, wherein the flow tube comprises ports that create hydraulic communication between the flow tube and the stinger.

6. The system according to claim 1, wherein the pressure chamber is disposed within the conduit of the stinger.

7. The system according to claim 1, further comprising a fluid-tight seal, created by a packer, between the pump intake and the pump discharge.

8. The system according to claim 1, further comprising a sand screen configured to filter sand disposed within the fluid.

9. The system according to claim 1, wherein the electric submersible pump further comprises a secondary pump that provides a discharge pressure to move the piston of the flow regulating valve.

10. The system according to claim 9, wherein the secondary pump is disposed downhole of the pump.

11. The system according to claim 10, wherein the secondary pump comprises a pump intake tube disposed within the flow tube of the flow regulating valve.

12. The system according to claim 1, wherein the electric submersible pump and the pressure chamber of the flow regulating valve are in hydraulic communication through capillary tubes.

13. The system according to claim 12, wherein the capillary tubes are filled with a hydraulic fluid.

14. The system according to claim 1, wherein the spring is fixed to the spring support.

15. The system according to claim 14, wherein the spring is connected to the piston.

16. A method, comprising:

activating a pump of an electric submersible pump;

pressure-sealing, by a plurality of seals, a pressure chamber of a flow regulating valve such that a pressure force within the pressure chamber is applied upon a piston;

moving, by the piston, a flow tube within the flow regulating valve;

receiving a fluid through a pump intake from a production tubing of a well, the fluid flowing from the production tubing to the pump intake through a stinger having a conduit;

venting, by a pump discharge, the fluid to a surface location;

positioning, by a spring, the piston within the flow regulating valve when the pump is inactive; and blocking, by the flow tube, the fluid from entering the pump intake;

wherein the spring is disposed within a cavity bounded between an upper end of the piston and a spring support, wherein the spring abuts and acts upon the piston and the spring is supported by and fixed to the spring support.

17. The method according to claim 16, further comprising setting a packer within the well between the pump intake and the pump discharge, thereby preventing fluid recirculation.

18. The method according to claim 16, wherein moving the flow tube comprises aligning ports of the flow tube with intake slots of the stinger, thereby permitting the fluid to enter the stinger.

19. The method according to claim 16, wherein moving the piston comprises applying a discharge pressure created by the electric submersible pump upon the piston.

20. The method according to claim 19, further comprising utilizing capillary tubes to transfer the discharge pressure from the electric submersible pump to the flow regulating valve.

* * * * *